US008029387B2

(12) United States Patent
Breton

(10) Patent No.: US 8,029,387 B2
(45) Date of Patent: Oct. 4, 2011

(54) CORRECTING GOLF TEE

(75) Inventor: Gerard A. Breton, Navan (CA)

(73) Assignee: Gerard A. Breton, Navan, ON (CA)

( * ) Notice: Subject to any disclaimer, the term of this patent is extended or adjusted under 35 U.S.C. 154(b) by 141 days.

(21) Appl. No.: 11/437,781

(22) Filed: May 22, 2006

(65) Prior Publication Data

US 2006/0211519 A1 Sep. 21, 2006

Related U.S. Application Data

(63) Continuation of application No. 10/857,874, filed on Jun. 2, 2004, now abandoned.

(51) Int. Cl.
*A63B 57/00* (2006.01)

(52) U.S. Cl. ..... 473/387

(58) Field of Classification Search ..... 473/387–403, 473/284, 408; D21/717–719
See application file for complete search history.

(56) References Cited

U.S. PATENT DOCUMENTS

| | | | | | |
|---|---|---|---|---|---|
| D67,255 | S | * | 5/1925 | Alvord | D21/718 |
| 1,596,110 | A | * | 8/1926 | Lynch | 473/387 |
| 1,638,527 | A | * | 8/1927 | Clausing | 473/402 |
| 1,656,401 | A | | 1/1928 | Totten | |
| 1,664,400 | A | | 4/1928 | Copp | |
| 1,671,813 | A | * | 5/1928 | Clarke | 473/403 |
| 2,033,269 | A | * | 3/1936 | Williams | 473/257 |
| D161,602 | S | * | 1/1951 | Ward | D21/718 |
| 3,347,551 | A | | 10/1967 | Dreyfus | |
| 3,414,268 | A | | 12/1968 | Chase | |
| 3,473,812 | A | | 10/1969 | Pelzmann | |
| 3,506,263 | A | | 4/1970 | Arrington | |
| 3,782,723 | A | | 1/1974 | Morris | |
| 3,947,027 | A | * | 3/1976 | Brown | 473/278 |
| 4,367,879 | A | | 1/1983 | Messer | |
| 4,448,909 | A | | 5/1984 | Golba | |
| 4,787,637 | A | * | 11/1988 | Lima et al. | 473/396 |
| 4,948,130 | A | * | 8/1990 | Rydborn | 473/391 |
| 4,951,945 | A | | 8/1990 | Gamble | |
| 5,121,519 | A | * | 6/1992 | Haugom | 473/408 |
| 5,193,803 | A | * | 3/1993 | Flick, III | 473/392 |
| 5,195,743 | A | * | 3/1993 | Walsh, Jr. | 473/401 |
| 5,221,090 | A | * | 6/1993 | Hong | 473/391 |
| 5,240,254 | A | | 8/1993 | Adlam | |
| 5,301,950 | A | * | 4/1994 | Patterson | 473/278 |
| 5,383,668 | A | * | 1/1995 | Andrikian | 473/132 |
| 5,529,299 | A | * | 6/1996 | Bellagamba | 473/408 |
| 5,738,598 | A | * | 4/1998 | Wu | 473/392 |
| 5,913,737 | A | * | 6/1999 | Park | 473/386 |
| 6,046,142 | A | | 4/2000 | Zilonis | |
| 6,062,990 | A | | 5/2000 | Pierce | |
| D431,849 | S | * | 10/2000 | MacDonald | D21/718 |
| 6,139,449 | A | | 10/2000 | Cardarelli | |
| 6,176,794 | B1 | | 1/2001 | Kim | |
| D439,944 | S | * | 4/2001 | Graham | D21/717 |

(Continued)

*Primary Examiner* — Steven Wong
(74) *Attorney, Agent, or Firm* — Global Intellectual Strategies; Pierrette Breton

(57) ABSTRACT

A trajectory correcting golf tee constructed with a stem for inserting into the ground and for supporting a golf ball in a fixed position above the ground. The stem is tapered so as to easily insert into the ground in a generally vertical position. The golf tee further includes a top surface with a depression to accept and retain a golf ball. The improvement including an elevated portion along one or two opposing edges of the top surface so as to control and correct a golf ball trajectory.

21 Claims, 2 Drawing Sheets

Tee with Funnel Shaped Stem

U.S. PATENT DOCUMENTS

| | | | | |
|---|---|---|---|---|
| 6,224,502 | B1 * | 5/2001 | Warfield | 473/408 |
| 6,280,350 | B1 | 8/2001 | Chung | |
| 6,344,003 | B1 | 2/2002 | Choung | |
| D491,990 | S * | 6/2004 | Lu | D21/717 |
| 6,811,499 | B1 * | 11/2004 | Hsien | 473/396 |
| 6,960,143 | B2 * | 11/2005 | Sato | 473/387 |
| 2001/0029212 | A1 * | 10/2001 | Dovigi | 473/387 |
| 2003/0148830 | A1 * | 8/2003 | Hsiao | 473/387 |
| 2006/0287135 | A1 * | 12/2006 | Pommereau | 473/387 |

* cited by examiner

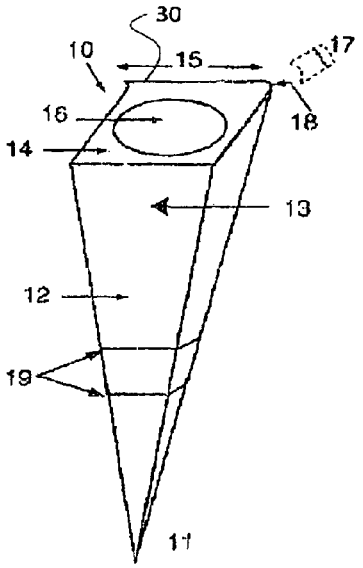
FIG. 1 Tee with Funnel Shaped Stem
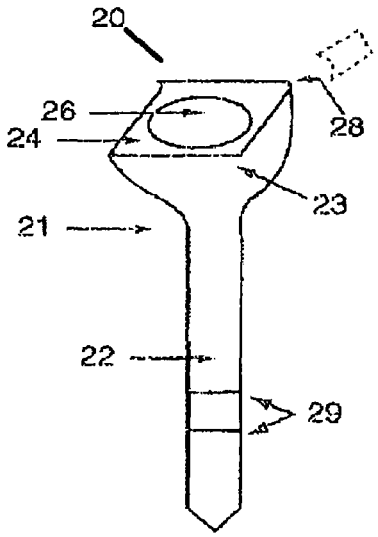
FIG. 2 Tee with Universally Accepted Stem

CORRECTING GOLF TEE

CROSS-REFERENCE TO RELATED APPLICATIONS

This application claims benefit of the Canadian priority application, number 2,432,305 filed Jun. 6, 2003 and is a continuation of application Ser. No. 10/857,874 filed Jun. 2, 2004 now abandoned.

MICROFICHE APPENDIX

Not applicable.

FIELD OF INVENTION

This invention relates in general to golf tees, for example, a device to support a golf ball above the surface of the ground, and in particular the invention relates to drive correcting tees.

BACKGROUND OF THE INVENTION

One of the most frustrating aspects of golf is a tee shot that hooks or slices. Although all shots taken from the fairway and putting can also cause frustration, a bad tee shot can set the player back. A lost ball, or having to correct from a bad lie can shake a player's confidence and most certainly will cause additional strokes to be added.

For a right handed player, a hook occurs when a ball shifts from moving right to moving to the far left during flight, while a slice occurs when the trajectory changes from left to far right. For a left handed player, a slice occurs when a ball moves to the far left and a hook occurs when a ball moves to the far right. Hooks or slices are typically caused by improperly gripping the club or an improper swing. They typically stay with a player for some time and it is difficult to correct from them. Less advanced golfers will inconsistently tee off in one direction or another without understanding what they are doing to cause the ball to travel away from the intended direction.

The universally accepted golf tee is a simple tee comprising a stem that is insertable into the ground with a depression in the top to accept and retain a golf ball. This tee holds the golf ball in an elevated position above the ground, prior to the tee shot, but does not correct the trajectory of the traveling ball.

It is advantageous for a tee shot to project the golf ball straight down the fairway and to travel the distance the player desires, for the most part this is as far as possible.

Many solutions have been proposed to achieve this. For example, U.S. Pat. No. 2,033,269, issued Mar. 10, 36 to Williams and U.S. Pat. No. 3,506,263, issued Apr. 14, 70 to Arrington, disclose a shield or cup that extends upward and shields the ball from the impact of the club. While these designs do make a difference to the spin imparted to the ball, they may decrease the distance the ball will travel.

Another example, U.S. Pat. No. 3,947,027, issued on Mar. 30, 76 to Brown, proposes a tee with a projection extending outwardly for meeting the golf club prior to the ball. This design supposedly imparts an initial backward spin to the ball and may improve the flight characteristics of the ball and thus the distance traveled. It may also be difficult to properly use and thus will provide for inconsistent results.

Yet another example, U.S. Pat. No. 4,367,879, issued Jan. 11, 83 to Messer discloses a tee with arms for partially encircling and frictionally gripping the golf ball to control the spin and trajectory. This design is fairly complex, the use requires thought and consideration and it would likely not be permitted in tournaments.

U.S. Pat. No. 4,418,909, issued Dec. 6, 83 to Messana describes using an adhesive to hold the golf ball in place on the tee. Use of the adhesive results in providing anti-spin characteristics necessary to reduce ball hooks and slices. The adhesive must be applied to the tee in a suitable quantity and size to achieve the desired result.

Although all of the above patents describe a tee which may control spin and reduce hooks and slices they either decrease the distance the ball will travel, provide inconsistent results or are complex to use and require planning prior to setting up the tee.

Clearly it is obvious that a simple to use tee which will provide consistently straight drives without providing additional drag or resistance to the golf ball is needed.

SUMMARY OF THE INVENTION

It is therefore an object of the present invention to provide a golf tee that substantially obviates one or more of the problems due to limitations and disadvantages of the related art.

In one object of the present invention there is provided a golf tee which corrects the tendency of a ball to travel left or right and launches the golf ball in a straight path, improving the flight trajectory.

Therefore, in accordance with the present invention there is provided an improved golf tee including a lower end and an upper end, the lower end for inserting into the ground, the upper end terminating at a top surface with a depression shaped in the top surface, the depression for accepting and retaining a golf ball. The top surface including at least one elevated portion, each elevated portion located along one, substantially entire, edge of the top surface wherein the elevated portion lies on either side of a golf ball and acts as an instant guide to the trajectory of the golf ball at play.

In accordance with another aspect of the present invention the top of the tee is square.

In accordance with another aspect of the present invention the elevated portion is substantially one sixteenth (1/16") of an inch in height.

In accordance with another aspect of the present invention the elevated portion is to one side of the depression and top surface.

In another aspect of the present invention there is provided two elevated portions, located along the edge of opposing sides of the top surface.

In accordance with yet another aspect of the present invention the stem is tapered along its length, producing a funnel shape, to permit easy insertion into and removal from the ground.

In yet another aspect of the present invention there is provided an improved golf tee comprising a four sided tapered stem for inserting into the ground in a generally vertical position, the stem terminating at a top surface and the top surface including a depression to accept and to retain a golf ball, the top surface further including an elevated portion located along one edge of the top surface, the elevated portion having a height substantially of one sixteenth of an inch.

An advantage of the present invention is that the tee promotes a straight trajectory of the ball, minimizing hooks and slices.

Another advantage of the present invention is that the tee corrects and promotes a straight trajectory of the ball without providing additional resistance and thus decreasing the distance traveled.

Yet another advantage of the present invention is the ease with which the tee may be used. Simply, the tee is inserted into the ground with the elevated side on the side of the expected ball trajectory. For example, if the player tends to hook, ball moves to the left, then the elevated side is placed closest to the player. If the player tends to slice, ball moves to the right, then the elevated side is placed farthest from the player. To be clear, the elevated side is not placed in front of or behind the ball.

Yet another advantage of the present invention is provided by the tapered shape of the stem. The taper, when inserted into the ground creates a funnel shape opening in the ground. This shape reduces breakage of the tee upon impact by the club and prolongs the useful life of the tee.

BRIEF DESCRIPTION OF THE DRAWINGS

FIG. 1 is a perspective view of a tee of the present invention with a tapered, funnel shaped stem.

FIG. 2 is a perspective view of a tee of the present invention with a universally accepted shape for the stem.

DETAILED DESCRIPTION OF THE PREFERRED EMBODIMENT

Figure 3:
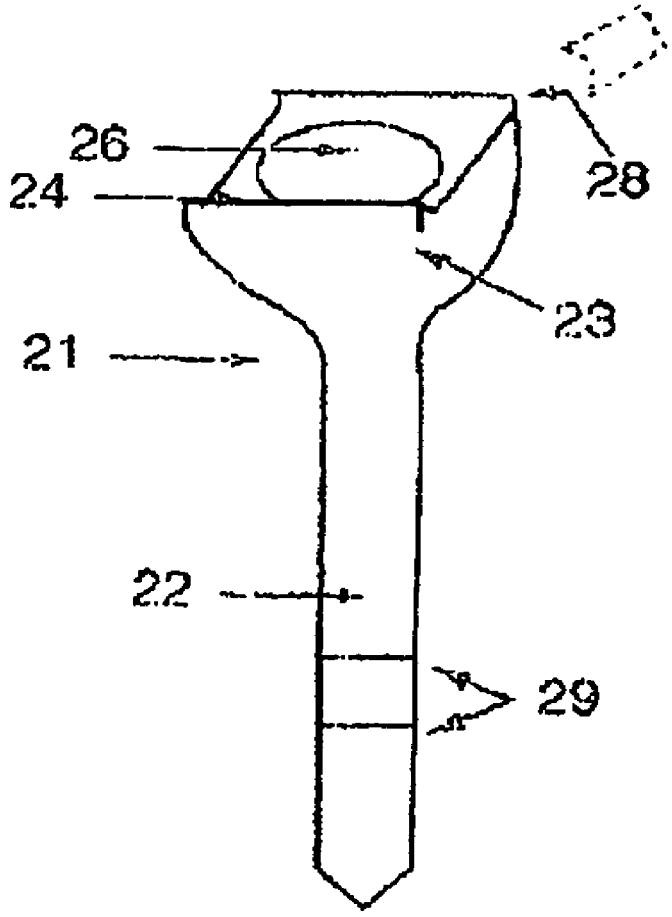

Turning to FIG. 1 there is illustrated a golf tee designated generally by the numeral 10, constructed in accordance with the present invention. The golf tee 10 includes a stem 12 for supporting a golf ball in a fixed position above the ground. The golf tee 10 includes a tapered stem 12 having a lower end 11 shaped substantially to a narrow point, allowing for easy insertion into the ground in a generally vertical position where a ball is to be played. The tapered stem 12 further including an upper end 13 terminating at a top surface 14. A circular depression or recess 16 is shaped into the top surface 14 for accepting and retaining a golf ball in a fixed position prior to play.

The golf tee 10 further includes an elevated portion or flange 18 extending upwardly from the edge of surface 14 along one side of the tee 10. An upper edge 30 of the elevated portion or flange 18 forms a straight line proximate the edge of the surface 14. The elevated portion 18 provides an instant guide off the tee when the golf ball is played or hit by a golf club. The elevated portion 18 controls and corrects a golf ball trajectory.

The tee 10 may be round, square, rectangular or generally of any shape providing that the elevated portion or flange 18 is of sufficient length 15 and height 17 to control and correct the golf ball trajectory without interfering with the seating of the golf ball in the depression 16. Further, the elevated portion or flange 18 will be shaped so as to substantially follow the contour of the golf ball, when the golf ball sits in the depression 16, but not necessarily along the entire edge 30[15] of the elevated portion 18. Specifically the elevated portion or flange 18 extends upwardly to form a curved shape having a curvature substantially matching the contour of the golf ball.

Typical dimensions for the tee 10 are such that the golf ball is struck by the club before the tee is. In other words, the top surface of the tee 14, the largest horizontal dimension, is smaller than the diameter of the golf ball.

Preferably the top surface 14 of the tee 10 is square and is approximately five eights of an inch (⅝") on each side. The tee 10 tapers to a sufficient dimension so as to be easily inserted into the ground. The typical length for the tee 10 is approximately two and five eights inches (2⅝").

For proper retaining of the golf ball the depression 16 in the top surface 14 is approximately one half of an inch (½") in diameter. As is understood by one skilled in the art, these dimensions are approximate and may vary without taking away from the advantages of the invention.

For ideal control, the elevated portion 18 is to be approximately one sixteenth (1/16") to three sixteenths (3/16") of an inch high with the ideal height being one sixteenth (1/16") to one eight (⅛") of an inch. The elevated portion 18 may be higher, but with increased height the elevated portion 18 becomes less stable and tends to chip. Further, with increased height the elevated portion 18 interferes too much with the golf ball and may provide friction and decrease the distance the ball will travel. Flange heights below one sixteenth (1/16") of an inch provide for less consistency in correction.

The elevated portion or flange 18 is of the same length 15 as the side it is on. This is necessary to provide an instant guide off the tee when the ball is played. If the tee 10 is round the elevated portion or flange 18 must substantially be the same length or more as the diameter of the top surface 14 of the tee. It is necessary for the elevated portion 18 to be straight and not include an arc portion. This is desirable so as not to provide further friction or hindrance to the golf ball when it is struck by a club.

The width 17 of the elevated portion 18 may vary, but preferable is kept to approximately two to three sixteenths of an inch (2/16" to 3/16") in order not to introduce bulk to the tee 10.

Elevated portion 18 may be placed on opposing sides of the tee 10, for example, when in play, on the left and right sides of the golf ball. When two elevated portions 18 are present on the same tee 10, the tee 10 tends to be larger, bulkier and may not be accepted for use in tournaments or on certain golf courses. Further it is not necessary to have elevated portions 18 on opposing sides of the depression 16 as a person tends to slice or hook, drive' right or left, and typically does not do both.

In use, the tee 10 is inserted into the ground at a desired location for tee off. The tee 10 is inserted to a depth desired by the player. The tee 10 may be marked with notches, straight marks 19 or other marks along the stem 12 in order to facilitate insertion to a constant depth as selected by the player. The tee 10 is inserted so that the length of the elevated portion 18 is in the same direction as the desired shot. For example, if the player wishes to hit the golf ball to the center of the fairway the length of the elevated portion 18 should be aimed at the center of the fairway. Further if a player tends to drive right, slice for the right handed player and hook for the left handed player, the elevated portion 18 is to be placed on the right side of the ball, away from the player for a right handed player and closest to the player for a left handed player. Alternatively, if the player tends to drive left, hook for the right handed player and slice for the left handed player, the elevated portion 18 is to be placed on the left side of the ball, closest to the player for a right handed player and away from the player for a left handed player.

The tee 10 may be construction of any material such as wood, plastic, ceramic or other material. Preferably the tee 10 is constructed of wood, as wood is degradable. Hard maple is ideal for tees 10 where reduced breakage and longer life is desirable. If made of wood, the tee may be painted in various colors, finished with a durable plastic coating or other finishing product or left natural.

Turning to FIG. 2 there is depicted an alternative embodiment of the present invention. The golf tee 20 includes a body 21 having a lower portion 22 and an upper portion 23, the body 21 for supporting a golf ball in a fixed position above the ground. The lower portion or stem 22 having a universally accepted shape for inserting into the ground. The upper portion 23 is contiguously shaped from the top of the stem 22 being generally larger than the stem 22, and terminating at a square top surface 24. A circular depression 26 is shaped into the top surface 24 for accepting and retaining a golf ball.

The golf tee 20 further includes an elevated portion or flange 28 rising up from the edge of top surface 24 along one side. The elongated portion 28 provides an instant guide off the tee 20 when the golf ball is impacted by a golf club. Although FIG. 2 shows a tee 20 with a substantially square upper portion 23 and top surface 24, it is to be understood that the top surface 24 and upper portion 23 may be substantially round, rectangular or of another shape.

In these alternative embodiments, the height of the elongated portion 28 is to be approximately one sixteenth (1/16") to three sixteenths (3/16") of an inch high with the ideal height being one sixteenth (1/16") to one eight (1/8") of an inch. Further, the length of the elongated portion 28 must substantially be the same length as the top surface in order to guide the ball adequately into a straight trajectory. For a golf tee with a substantially round upper portion 23 and top surface 24, the length of the elongated portion 28 must approximate the diameter of the top surface 24.

The embodiment(s) of the invention described above are intended to be exemplary only. The scope of the invention is therefore intended to be limited solely by the scope of the appended claims.

I claim:

1. An improved golf tee having a body with a lower end portion and an upper end portion, the lower end for inserting into the ground, the upper end terminating at a top surface, the improvement comprising:

the top surface having a depression for accepting and retaining a golf ball and including at least one and not more than two elevated flanges, each elevated flange located along one edge of the top surface directly above the upper end portion and extending upwardly from the top surface to form an upper edge forming a straight line proximate the edge of the top surface for guiding the golf ball on impact, and each elevated flange being situated to the left or right of the golf ball in relation to the hitting direction such that the elevated flange does not support the golf ball when the golf ball rests in the depression prior to the impact.

2. An improved golf tee having a body with a lower end portion and an upper end portion, the lower end for inserting into the ground, the upper end terminating at a top surface, the top surface including a depression for accepting and retaining a golf ball, the improvement comprising:

the top surface further including an elevated flange located along only one edge of the top surface directly above the upper end portion and extending upwardly from the top surface to form an upper edge forming a straight line proximate the edge of the top surface for guiding the golf ball on impact, and the elevated flange being situated to the left or right of the golf ball in relation to the hitting direction and not supporting the golf ball when the golf ball rests hi the depression prior to the impact, the elevated flange for promoting a straight trajectory of the ball when the ball is struck during play.

3. The improved golf tee as claimed in claim 1 wherein the depression includes a bottom surface on which the golf ball rests.

4. The improved golf tee as claimed in claim 1 or 2 wherein the elevated flange is substantially one sixteenth of an inch in height.

5. The improved golf tee as claimed in claim 1 or 2 wherein the elevated flange is less than three sixteenths but more than one sixteenth of an inch in height.

6. The improved golf tee as claimed in claim 1 or 2 wherein the top surface is generally square.

7. An improved golf tee as claimed in claim 1 or 2 wherein the lower end is funnel shaped.

8. The improved golf tee as claimed in claim 1 or 2 wherein the golf tee is tapered along its length and terminating substantially to a point for easy insertion into the ground.

9. The improved golf tee as claimed in claim 1 or 2 wherein the lower end of the golf tee is generally of the same diameter for most of its length.

10. The improved golf tee as claimed in claim 1 wherein the tee is made of wood.

11. The improved golf tee as claimed in claim 1 or 2 wherein the elevated flange is shaped similarly to the contour of the golf ball as the golf ball rests in the bottom of the depression.

12. The improved golf tee as claimed in claim 1 wherein elevated flanges of similar heights are provided on opposing sides of the top surface.

13. An improved golf tee having a body with a tapered stem for inserting into the ground in a generally vertical position, the stem terminating at a top surface and the top surface having a depression for accepting and retaining a golf ball, the improvement comprising:

the top surface including at least one elevated portion, each elevated portion located along one edge of the top surface directly above the body and extending upwardly from the top surface to form an upper edge forming a straight line proximate the edge of the top surface for guiding the golf ball on impact, wherein the elevated portion is situated to the left or right of the golf ball in relation to the hitting direction such that the elevated portion does not support the golf ball when the golf ball rests in the depression prior to the impact and;

the top surface sized so that when a golf club is swung at a golf ball resting on the golf tee, the golf club strikes the ball before the tee.

14. The improved golf tee as claimed in claim 13 wherein the depression includes a bottom surface on which the golf ball rests.

15. The improved golf tee as claimed in claim 13 wherein the elevated portion is substantially one sixteenth of an inch in height and extends upwardly to form a curved shape comprising a curvature substantially matching the contour of the golf ball.

16. The improved golf tee as claimed in claim 13 or 14 wherein the stem has four sides.

17. An improved golf tee for acting as an instant guide to the trajectory of a golf ball at play comprising:

a body having a four sided tapered stem for inserting into the ground in a generally vertical position, the stem terminating at a top surface and the top surface including a depression to accept and to retain a golf ball, the top surface further including an elevated portion located along one edge of the top surface directly above the body and extending upwardly from the top surface to form an upper edge forming a straight line, the elevated portion having a height substantially of one sixteenth of an inch and situated only to the left or right of the golf ball in relation to the hitting direction such that the elevated portion does not support the golf ball when the golf ball rests in the depression prior to impact.

18. The improved golf tee as claimed in claim 17 wherein the stem is tapered along its length and terminating substantially to a point for easy inserting into the ground.

19. The improved golf tee as claimed in claim 17 wherein the elevated portion occupies substantially the entire one edge of the tee.

20. The improved golf tee as claimed in claim 17 wherein elevated portions of similar heights are provided on opposing sides of the top surface.

21. The improved golf tee as claimed in claim 17 wherein the depression includes a bottom surface on which the golf ball rests.

* * * * *